US008469532B2

(12) United States Patent
Pae

(10) Patent No.: US 8,469,532 B2
(45) Date of Patent: Jun. 25, 2013

(54) REFRIGERATOR AND HANDLE OF THE SAME

(75) Inventor: Chanju Pae, Changwon (KR)

(73) Assignee: LG Electronics Inc., Seoul (KR)

( * ) Notice: Subject to any disclaimer, the term of this patent is extended or adjusted under 35 U.S.C. 154(b) by 414 days.

(21) Appl. No.: 12/918,652

(22) PCT Filed: Dec. 19, 2008

(86) PCT No.: PCT/KR2008/007564

§ 371 (c)(1),
(2), (4) Date: Aug. 20, 2010

(87) PCT Pub. No.: WO2009/104863

PCT Pub. Date: Aug. 27, 2009

(65) Prior Publication Data

US 2010/0326115 A1 Dec. 30, 2010

(30) Foreign Application Priority Data

Feb. 21, 2008 (KR) ..... 10-2008-0015782

(51) Int. Cl.
*F21V 33/00* (2006.01)
*F25D 27/00* (2006.01)
*F27D 21/02* (2006.01)

(52) U.S. Cl.
USPC ..... 362/92; 362/109; 362/501; 16/412; 16/110.1; 16/111.1; 312/332.1

(58) Field of Classification Search
USPC ..... 362/92, 577, 501, 100, 102, 109, 362/154; 312/116, 405, 401, 405.1, 223.5, 312/348.6, 332.1; 62/264, 441; 16/412, 110.1, 16/111.1, 113.1, 407, 413, 415, 416, 422, 16/425, DIG. 18, DIG. 24
See application file for complete search history.

(56) References Cited

U.S. PATENT DOCUMENTS

| | | | | |
|---|---|---|---|---|
| 2004/0183413 | A1* | 9/2004 | Koo | 312/401 |
| 2006/0080994 | A1* | 4/2006 | Seiden et al. | 62/441 |
| 2008/0244869 | A1* | 10/2008 | Bae et al. | 16/412 |
| 2009/0139260 | A1* | 6/2009 | Yoshikawa et al. | 62/449 |
| 2010/0189935 | A1* | 7/2010 | Kim | 428/34.5 |
| 2010/0287843 | A1* | 11/2010 | Oh | 49/460 |

FOREIGN PATENT DOCUMENTS

| | | | |
|---|---|---|---|
| KR | 20-1999-0027380 | U | 7/1999 |
| KR | 10-2007-0028188 | A | 3/2007 |
| KR | 10-2007-0069665 | A | 7/2007 |
| WO | WO 2007/029978 | A1 | 3/2007 |

* cited by examiner

*Primary Examiner* — Anh Mai
*Assistant Examiner* — Kevin Quarterman
(74) *Attorney, Agent, or Firm* — Birch, Stewart, Kolasch & Birch, LLP

(57) ABSTRACT

The present invention relates to a refrigerator and a handle thereof. The handle of the refrigerator includes a supporter; a decoration member installed at the supporter; a cover member covering the decoration member and is provided with a transmissive part through which light is passed; and a light-emitting unit which emits light, wherein at least some of the light emitted from the light-emitting unit passes through the transmissive part.

14 Claims, 3 Drawing Sheets

REFRIGERATOR AND HANDLE OF THE SAME

TECHNICAL FIELD

This document relates to a refrigerator and a handle thereof.

BACKGROUND ART

Generally, a refrigerator is an apparatus that allows foods to be stored at a low temperature.

The refrigerator includes a main body in which a storage chamber is formed, and a door which opens or closes the storage chamber by being connected to the main body. And, a handle, which allows users to grasp it, is provided at the door.

DISCLOSURE OF INVENTION

Technical Problem

An object of the present embodiment is to provide a refrigerator and a handle of the same, which improves an aesthetic appearance as light is emitted by a light-emitting unit to the outside.

Technical Solution

According to an aspect of the present embodiment, there is provided a handle of a refrigerator, the handle including: a supporter; a decoration member installed at the supporter; a cover member for covering the decoration member and is provided with a transmissive part through which light is passed; and a light-emitting unit which emits light, wherein at least some of the light emitted from the light-emitting passes through the transmissive part.

According to another aspect of the present invention, there is provided a handle of a refrigerator, the handle including: a handle main body; a decoration member provided at the handle main body; a cover member for covering the decoration member; and a light-emitting unit which emits light, wherein at least some of the light emitted therefrom passes through the cover member.

According to further another aspect of the present invention, there is provided a refrigerator, including: a main body in which a storage chamber is formed; a door to open/close the storage chamber; a handle provided at the door; a decoration member installed at the handle so that it can be recognized from the outside; and a light-emitting unit provided at the handle to emit light, wherein at least some of the emitted light is irradiated onto the decoration member.

Advantageous Effects

According to the proposed embodiments of the present invention, there is an advantage in that an aesthetic appearance of a refrigerator is generated and users may easily recognize the decoration member in a dark state, since the light emitted form a light-emitting unit and the light refracted or reflected at a decoration member pass through the transmissive part.

Also, there is an advantage in that an aesthetic appearance of the decoration member is improved, since the light emitted from the light-emitting unit passes toward the decoration member.

Furthermore, there is an advantage in that users may easily recognize a handle in a dark state because of the light emitted from the light-emitting unit. That is, the light-emitting unit may serve as an indoor light.

BRIEF DESCRIPTION OF THE DRAWINGS

FIG. 6 is a perspective view of the handle showing a state where a light-emitting unit according to the first embodiment is turned-on.

MODE FOR THE INVENTION

Hereinafter, preferred embodiments of the present invention will be explained in detail with reference to the accompanying drawings.

Figure 1:
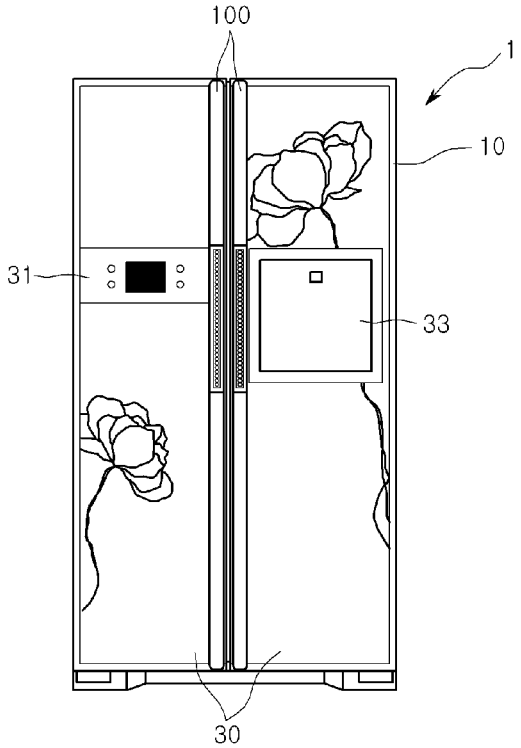
FIG. 1 is a front view of a refrigerator according to a first embodiment.

FIG. 1 shows a refrigerator according to a first embodiment in a front view.

Even though a side by side type refrigerator in which a refrigerating chamber and a freezing chamber are horizontally arranged side-by-side is illustrated in FIG. 1, however the scope of the present invention is not restricted thereto, and also it should be noted that the present invention may be applied to a top mount type refrigerator in which a freezing chamber is disposed above a refrigerating chamber and to a bottom freezer type refrigerator in which a freezing chamber is disposed below a refrigerating chamber.

Furthermore, the scope of the present invention may be applied to a refrigerator in which only one of a freezing chamber and a refrigerating chamber is formed.

Referring to FIG. 1, a refrigerator 1 of the present invention includes a main body 10 in which at least one storage chamber is formed, and a door 30 which opens/closes the storage chamber as it is connected to the main body 10. The door 30 is movably, for example rotatably, connected to the main body 10.

The door 30 includes a door main body which defines the appearance. The door main body is provided with a display assembly 31 for showing the operational state of the refrigerator, Also, the door 30 may be provided with a home bar 33 for easily taking out foodstuffs in the storage chamber, or with a dispenser (not shown) for dispensing water or ice.

And, the door 30 includes a handle 100 which allows users to grasp it. The handle 100 may be configured that some of the door main body is depressed or protruded, or that a separate part is connected to the door main body. FIG. 1, for example, illustrates the handle 100 which is manufactured as a separate part and is connected to the door main body.

Figure 2:
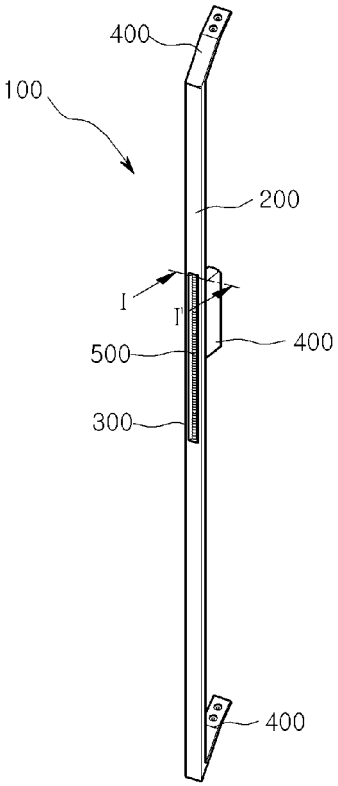
FIG. 2 is a perspective view of a handle according to the first embodiment.
Figure 3:
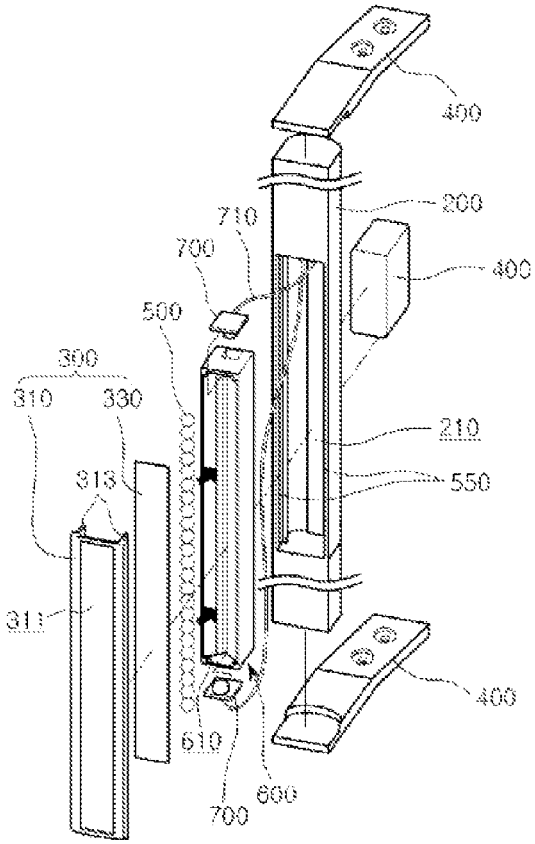
FIG. 3 is an exploded perspective view of the handle according to the first embodiment.
Figure 4:
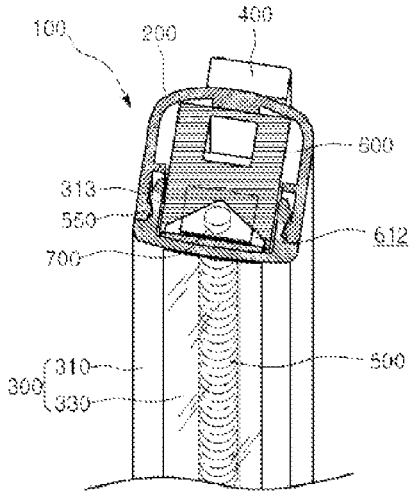
FIG. 4 is a cross-sectional view taken along I-I' in FIG. 2.

FIG. 2 shows a handle according to the first embodiment in a perspective view, FIG. 3 shows the handle according to the first embodiment in an exploded perspective view, and FIG. 4 shows a cross-sectional view taken along I-I' in FIG. 2.

Referring to FIGS. 2 to 4, the handle 100 includes a handle main body 200, and a cover member 300 which is connected to the handle main body 200.

A connecting member 400 for spacing apart the handle main body 200 from a front surface of the door main body is formed at the handle main body 200.

The connecting member 400 may be formed at upper, lower and midlle portion of the handle main body 200, and it should be noted that the location of the connecting member 400 is not restricted thereto.

A accommodating portion 210 for receiving a supporter 600, which will be described below, is formed at the handle main body 200. The accommodating portion 210 is depressed and formed at the handle main body 200. And, the accommodating portion 210 is covered by the cover member 300.

A plurality of decoration members 500 for improving an aesthetic stylish appearance of the refrigerator are installed at the supporter 600. The plurality of decoration members 500 may be made of various materials, such as cubic or crystal, precious metal ore, and glass.

And, the respective decoration member 500 may be made of a transparent or semi-transparent material, through which light can pass. And, the respective decoration member 500 may be made of a sphere or polyhedron. The supporter is formed long in a vertical direction, and a mounting portion 610 for accommodating the plurality of decoration members is depressed and formed. The plurality of decoration members 500 are vertically arranged in a row. Of course, the plurality of decoration members 500 may be horizontally arranged in row, which are at least 2 rows, and be regularly or irregularly arranged.

A surface of the mounting portion 610 may be coated with a material capable of reflecting light, or a reflective layer to which a film capable of reflecting light is attached may be formed thereon.

At upper and lower parts of the supporter, a light-emitting unit 700 for emitting light to the decoration member 500 is provided. Unlike this, the light-emitting unit 700 may also be provided at only one of upper or lower part of the supporter 600.

The respective light-emitting unit 700 may be installed at the mounting portion 610. Unlike this, it is also possible that the respective light-emitting unit 700 is installed at the outside the supporter 700, and a hole 612 is formed in the supporter 600 such that light from the light-emitting unit 700 can be emitted to the decoration member 500 via the hole 612.

And, the light emitted from the light-emitting unit 700 may pass through a plurality of decoration members. For example, the light-emitting unit 700 may be arranged on a straight line between at least 2 decoration members.

Meanwhile, a power line 710 for supplying electric power into the light-emitting unit 700 can be electrically connected to the light-emitting unit 700 along the connecting member 400.

The cover member 300 is connected to the handle main body 200, thereby defining a part of the external appearance of the handle 100.

The cover member 300 includes a cover frame 310 in which a transmissive hole 311 is formed, and a transmissive part 330 which is connected with the cover frame 310 and allows the decoration member 500 to be exposed to the outside. The cover frame 310 is connected to the handle main body 200. The transmissive part 330 may be transparently or semi-transparently formed.

A connecting part 313 for connecting with the the handle main body 200 is formed at the cover frame 310. And, a hook 550 to which the connecting part is fastened is formed at the mounting portion 210 of the handle main body 200.

Meanwhile, in case the cover member 300 is connected to the handle main body 200 in a state that the decoration member 500 is mounted on the mounting portion 610, the decoration member 500 is prevented from being moved as the decoration member 500 is contacted to the mounting portion 610 and a rear surface of the cover member 300.

According to the present embodiment, the supporter 600 is formed as a separate part and is accommodated in the handle main body 200, however it is also possible that the supporter 600 is formed integrally with the handle main body 200. In this case, handle main body 200 serves as a supporter.

Figure 5:
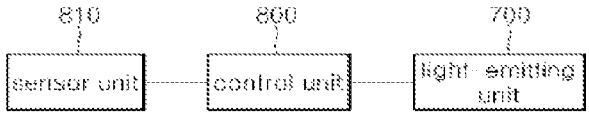
FIG. 5 is a block diagram showing a control structure of the refrigerator according to the first embodiment.
Figure 6:
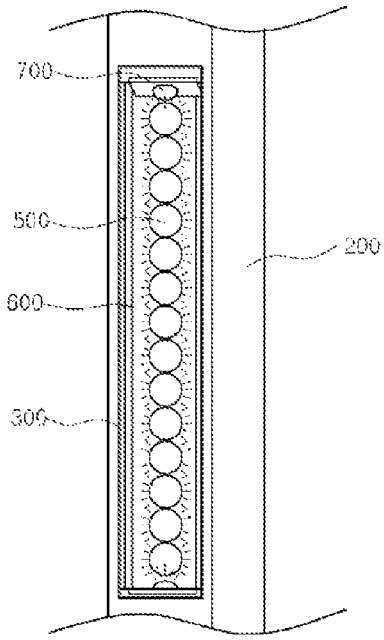

FIG. 5 shows a control structure of the refrigerator according to the first embodiment in a block diagram, and FIG. 6 shows a handle in a state where a light-emitting unit according to the first embodiment is turned-on, in a perspective view.

Referring to FIGS. 5 and 6, the refrigerator 1 includes a control unit 800 for controlling the operation of the light-emitting unit 700, and a sensor unit 810 for detecting the intensity of illumination at the site where the refrigerator 1 is installed.

The control unit 800 may control the operation of the whole refrigerator, or it may be provided separately from a main control unit for controlling the operation of the main body of the refrigerator 1.

In case the intensity of illumination at the site where the refrigerator 1 is installed is higher than a standard value, the light-emitting unit 700 maintains the off state. In this state, users can recognize the patterns expressed on the exterior member 500 from the outside of the handle 100 without operating the light-emitting unit 700. Therefore, an aesthetic appearance of the refrigerator is improvded by the decoration member.

However, in case the intensity of illumination at the site where the refrigerator 1 is installed is lower than the standard value, it is hard for the users to recognize the patterns expressed on the exterior member 500. Accordingly, in case the intensity of illumination at the site is lower than the standard value, the control unit 810 allows the light-emitting unit 800 to be turned on.

After that, light is emitted from the light-emitting unit 700 to the decoration member 500.

The light emitted to the decoration member 500 passes through the decoration member 500, or the light is refracted or reflected by the decoration member.

And, the users can recognize the light of the light-emitting unit 700, since a part of light emitted from the light-emitting unit and the light refracted or reflected by the decoration member passes through the transmissive part 330. Here, the intensity of the light emitted from the light-emitting unit may be changed with respect to the intensity of illumination, which is detected by the sensor unit.

And, in case light is emitted from the light-emitting unit 700 to the decoration member 500, there are advantages in that users may easily recognize the decoration member 500 as well as an aesthetic appearance of the decoration member 500 is improved by the light.

Further, since the light emitted from the light-emitting unit 700 passes through the transmissive part 330, the light-emitting unit 700 serves as a light, and therefore users can find the exact position of the handle 100 even in a dark state.

Figure 7:
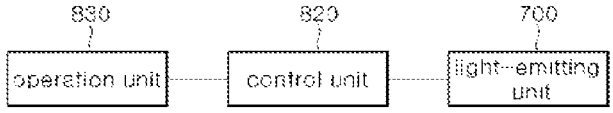
FIG. 7 is a block diagram showing a control structure of the refrigerator according to the second embodiment.

FIG. 7 shows a control structure of the refrigerator according to the second embodiment in a block diagram.

The present embodiment is almost the same as the first embodiment, except that the operation of the light-emitting unit is selected by the users. Hereinafter, characteristic parts of the present embodiment will be explained.

Referring to FIG. 7, the refrigerator of the present embodiment includes a light-emitting unit 700, an operation unit 830 for selecting whether the light-emitting unit 700 operates or not, and a control unit 820 for controlling at least the operation of the light-emitting unit 700 in accordance with the signal inputted through the operation unit 830.

In detail, in case the "ON" signal of the light-emitting unit 700 is inputted through the operation unit 830, the light-emitting unit 700 is operated by the control unit 820. And, in case the "OFF" signal of the light-emitting unit 700 is inputted through the operation unit 830, the light-emitting unit 700 is turned-off by the control unit 820.

Unlike this case, the period of the ON state of the light-emitting unit 700 reaches a certain period of time without the operation of the operation unit 830, the light-emitting unit 700 may be turned-off.

Figure 8:
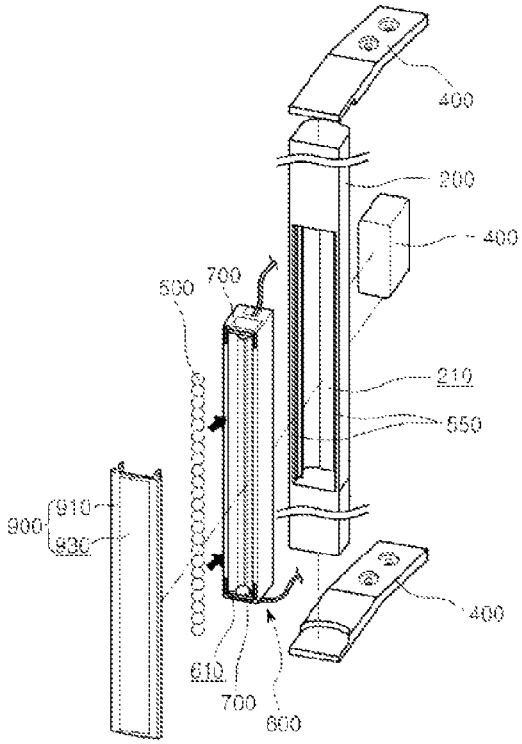
FIG. 8 is an exploded perspective view of a handle according to a third embodiment.

FIG. 8 shows a handle according to a third embodiment in an exploded perspective view.

The present embodiment is almost the same as the first embodiment, except for a structure of a cover member. Hereinafter, characteristic parts of the present embodiment will be explained.

Referring to FIG. 8, a cover member 900 according to the present embodiment covers the decoration member 500. The cover member 900 is connected with a handle main body 200. The cover member 900 includes a transmissive part 910 which is made of transparent or semi-transparent material to expose the decoration member 500 to the outside, and a cover frame 930 which constitutes edges of the transmissive part 910. That is, the transmissive part 910 and the cover frame 930 are integrally formed.

The invention claimed is:

1. A handle of a refrigerator, the handle comprising:

a handle main body provided with an accommodating portion;

a supporter received in the accommodating portion and having a mounting portion;

a V-shaped reflective layer in the mounting portion;

a plurality of three-dimensional decoration members installed at the supporter and positioned in front of the V-shaped reflective layer;

a cover member for covering the plurality of decoration members provided with a transmissive part through which light is passed; and a light-emitting unit which emits light, wherein at least some of the light emitted from the light-emitting unit passes through the transmissive part, and wherein the light-emitting unit is provided at at least one of upper or lower parts of the supporter.

2. The handle of a refrigerator according to claim 1, wherein at least some of the light emitted from the light-emitting unit passes through the plurality of decoration members.

3. The handle according to claim 1, wherein the light-emitting unit is connected to the supporter.

4. The handle according to claim 1, wherein the light-emitting unit emits light toward the mounting portion.

5. The handle of the refrigerator according to claim 1, wherein the plurality of decoration members are arranged regularly or irregularly.

6. The handle of the refrigerator according to claim 5, wherein light emitted from the light-emitting unit passes through the plurality of decoration members.

7. The handle of the refrigerator according to claim 1, wherein the light-emitting unit includes at least one LED.

8. The handle of the refrigerator according to claim 1, further comprising:

a sensor unit for detecting the intensity of illumination, wherein in case the intensity of illumination detected by the sensor unit is lower than a predetermined level, the light-emitting unit is turned on.

9. The handle of the refrigerator according to claim 1, further comprising:

an operation unit for inputting ON or OFF signals of the light-emitting unit.

10. A handle of a refrigerator, the handle comprising:

a handle main body;

a plurality of decoration members provided at the handle main body;

a cover member for covering the plurality of decoration members; and a light-emitting unit which emits light such that the plurality of decoration members can be easily recognized from the outside, wherein at least some of the emitted light passes through the cover member, and wherein the light-emitting unit and at least two of the plurality of decoration members are arranged on a straight line.

11. The handle of the refrigerator according to claim 10, wherein the light-emitting unit emits light toward the decoration member.

12. The handle of the refrigerator according to claim 10, wherein the cover member includes a cover frame connected to the handle main body, and a transmissive part through which light emitted from the light-emitting unit is passed.

13. The handle of the refrigerator according to claim 10, further comprising:

a supporter for supporting the decoration member, wherein the light-emitting unit is connected to the supporter.

14. The handle of the refrigerator according to claim 10, wherein the light-emitting unit includes a plurality of LEDs, and wherein one decoration member is disposed between two LEDs.

* * * * *